US007721980B1

(12) United States Patent
Widmer et al.

(10) Patent No.: US 7,721,980 B1
(45) Date of Patent: May 25, 2010

(54) METHOD AND APPARATUS FOR VACUUM COOLING OF VISCOUS MIXTURES

(75) Inventors: Wilbur Widmer, Winter Haven, FL (US); David Stewart, Boca Raton, FL (US); Karel Grohmann, Davenport, FL (US)

(73) Assignee: The United States of America as represented by the Secretary of Agriculture, Washington, DC (US)

( * ) Notice: Subject to any disclaimer, the term of this patent is extended or adjusted under 35 U.S.C. 154(b) by 754 days.

(21) Appl. No.: 11/599,056

(22) Filed: Nov. 14, 2006
(Under 37 CFR 1.47)

(51) Int. Cl.
*B02C 19/00* (2006.01)

(52) U.S. Cl. ..... 241/1; 241/23; 241/65; 241/301; 62/100

(58) Field of Classification Search ..... 62/100; 241/301, DIG. 14, 57, 23
See application file for complete search history.

(56) References Cited

U.S. PATENT DOCUMENTS

| | | | | |
|---|---|---|---|---|
| 1,973,084 A | | 9/1934 | Lewis | |
| 3,555,991 A | * | 1/1971 | Strakhov et al. | 99/455 |
| 3,756,475 A | * | 9/1973 | Emery | 222/195 |
| 3,966,984 A | | 6/1976 | Cocke et al. | |
| 4,113,573 A | | 9/1978 | Gerow | |
| 4,276,270 A | * | 6/1981 | Gragg et al. | 423/157.4 |
| 4,488,912 A | | 12/1984 | Milch et al. | |
| 4,503,079 A | | 3/1985 | King et al. | |
| 4,547,226 A | | 10/1985 | Milch et al. | |
| 4,564,595 A | | 1/1986 | Neves | |
| 4,650,689 A | | 3/1987 | Hedrick | |
| 4,818,250 A | | 4/1989 | Whitworth | |
| 4,915,707 A | | 4/1990 | Witworth | |
| 4,952,504 A | | 8/1990 | Pavilon | |
| 5,133,807 A | * | 7/1992 | De Cremoux | 127/15 |
| 5,135,861 A | | 8/1992 | Pavilon | |
| 5,198,074 A | | 3/1993 | Villavicencio et al. | |

(Continued)

OTHER PUBLICATIONS

Jacques, K., et al., "Ethanol Distillation: The Foundamentals", *The Alcohol Textbook*, 2003, pp. 325-326.

(Continued)

*Primary Examiner*—Dana Ross
*Assistant Examiner*—Matthew G Katcoff
(74) *Attorney, Agent, or Firm*—John D. Fado; Robert D. Jones

(57) ABSTRACT

A method and apparatus for vacuum cooling heated viscous and/or high solids mixtures employs at least one cooling tank (1) having inwardly sloping side walls (15) from a top (14) to an opening that is attached to a outlet pump or valve (7) located at the tank bottom, a rotational spreader (8) near the top and at least one vacuum pump (5, 6) to maintain the predetermined vacuum in the tank, and input and output pumps (20, 21). The rotational spreader (8) breaks up the heated viscous and/or high solids mixture (9) and distributes it onto the side walls of the tank to form a film (10) which is cooled as it travels to and slides down the sides to the bottom where the viscous and/or high solids mixture is outputted from the tank by a pump or valve (7, 21, 26). Multiple stages of the apparatus may be employed preferably with progressively greater vacuum pressure in each stage to accomplish even further cooling of the viscous and/or high solids mixtures.

21 Claims, 2 Drawing Sheets

U.S. PATENT DOCUMENTS

| | | | |
|---|---|---|---|
| 5,571,703 | A | 11/1996 | Chieffalo et al. |
| 6,076,362 | A | 6/2000 | Hubinger et al. |
| 6,143,337 | A | 11/2000 | Fishman et al. |
| 6,151,799 | A | 11/2000 | Jones |
| 6,183,806 | B1 | 2/2001 | Ficca et al. |
| 6,251,643 | B1 | 6/2001 | Hansen et al. |
| 6,267,309 | B1 | 7/2001 | Chieffalo et al. |
| 6,962,722 | B2 | 11/2005 | Dawley et al. |
| 2004/0091983 | A1 | 5/2004 | Veit et al. |
| 2005/0054064 | A1 | 3/2005 | Talluri et al. |

OTHER PUBLICATIONS

McDonald, K., et al., "Vacuum Cooling Technology for the Food Processing Industry: A Review", *J. of Food Engineering*, vol. 45, 2000, pp. 55-65.

* cited by examiner

METHOD AND APPARATUS FOR VACUUM COOLING OF VISCOUS MIXTURES

BACKGROUND OF THE INVENTION

This invention relates to treatments of high solids containing and/or viscous mixtures, more particularly to the vacuum cooling of a high solids containing and viscous mixture such as citrus waste.

In many production processes, such as the production of ethanol and extraction of oils and other byproducts from citrus waste, the high solids viscous mixture must be treated by cooking or heating to a high temperature, usually 95° C. or higher. Then the viscous mixture must be cooled to a lower temperature of approximately 45° C. or less to be able to add hydrolyzing enzymes and/or fermentation microorganisms without killing the organisms or inactivating the enzymes which are necessary for hydrolysis and/or fermentation of the solids to produce ethanol or other byproducts.

Conventionally the cooling of high solids containing and/or viscous mixtures has been accomplished by using scraped surface heat exchangers or by applying vacuum to batches of heated viscous mixtures in a suitable vessel. Unfortunately, the time necessary to properly cool a viscous mixture in batches is lengthy and thus delays the entire production process. Moreover, such cooling is uneven, as all batches do not cool evenly, leaving hot spots in the mixture. Furthermore, such cooling is not at a continuous flow rate commensurate with the production process (McDonald, K., and D. Sun, Journal of Food Engineering 45: 55-65 (2000)). Thus, the need exists for a method and apparatus for cooling viscous and/or high solids containing mixtures faster, more evenly and in a continuous fashion.

SUMMARY OF THE INVENTION

One object of the present invention is to provide a method and apparatus for rapid cooling of viscous and/or high solids mixtures.

Another object of the present invention is to provide a method and apparatus that cools viscous and/or high solids mixtures evenly.

A further object of the present invention is to provide such a method and apparatus that cools viscous and/or high solids mixtures on a continuous basis to prevent interruption and delays in the overall production process.

The present invention fulfills the above and other objects by providing an apparatus for vacuum cooling of the viscous and/or high solids mixtures, the apparatus having a tank with a top, a bottom and walls slanting inwardly at a predetermined angle from top to bottom. The tank has a valve or control pump for inputting the heated mixture into the top of the tank. The tank near the top further has a rotational spreader such as a disk or propeller (or spray jet) to disperse the heated mixture material into small particles, thereby increasing the exposed surface area of the material to the vacuum as the mixture travels to and runs down the sides of the tank. The tank employs one or more vacuum pumps for maintaining the vacuum in the tank and a control valve or pump to discharge the cooled mixture out of the tank to the next phase of a production process. The method of cooling the heated mixture to the final desired temperature may be accomplished in one or more stages using like apparatuses generally having successively higher vacuum pressure to further enhance cooling of the mixture.

The above and other projects, features and advantages of the present invention should become even more readily apparent to those skilled in the art upon a reading of the following detailed description in conjunction with the drawings wherein there is shown and described illustrative embodiments of the invention.

DETAILED DESCRIPTION OF THE INVENTION

Figure 1:
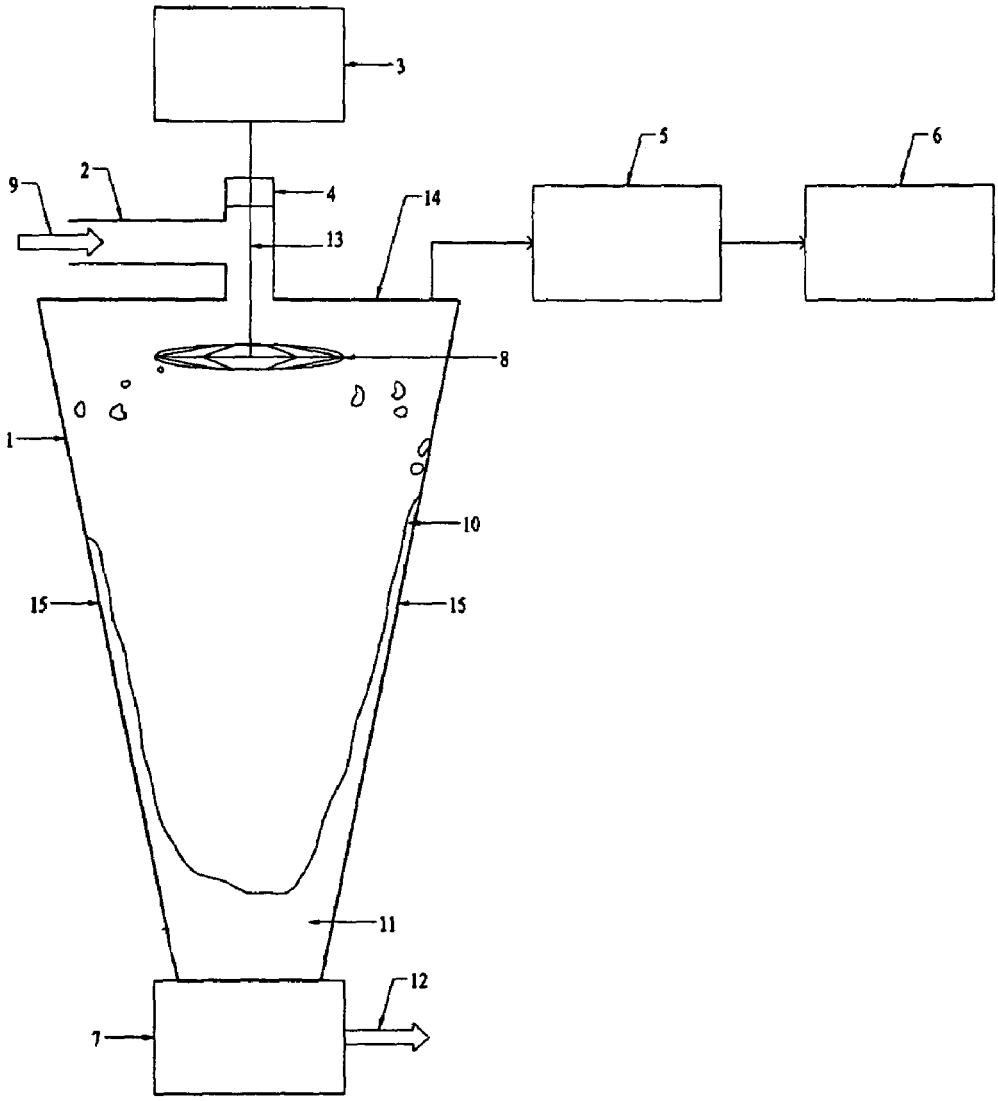
FIG. 1 shows a schematic diagram of a one-stage cooling embodiment employing the apparatus and method of the present invention.

For purposes of describing the preferred embodiment, the terminology used in reference to the numbered components in the drawings is as follows:

1. Cooling tank
2. Cooked/heated mixture input pipe
3. Rotational motor
4. Vacuum seal
5. Vacuum pump 1
6. Vacuum pump 2
7. Output control valve/pump
8. Rotational spreader
9. Heated/cooked mixture
10. Mixture film
11. Cooled mixture
12. Cooled mixture output
13. Shaft
14. Top of cooling tank
15. Side walls of cooling tank
16. First stage cooling tank
17. Rotational motor
18. Rotational spreader
19. Cooked/heated mixture
20. Input control valve/pump
21. Output control valve/pump
22. 2nd stage cooling tank
23. Rotational motor
24. Rotational spreader
25. 2nd stage mixture input
26. Output control valve/pump
27. Cooled mixture output
28. Optional stage-height difference Referring to FIG. 1, a cooling tank 1 of the apparatus of the invention is illustrated having a top 14 and sidewalls 15 which slope inward from the top 14 at a predetermined angle to a bottom outlet which is connected to the output control pump or valve 7. The angle at which the tank wall slopes from top to bottom is generally governed by the angle of the repose of the mixture or the angle required for the mixture to slide down the sidewall due to gravity so the film of mixture 10 on the side walls 15 slides slowly towards the bottom outlet which is attached to the output control pump or valve 7 to provide sufficient time for exposure to the vacuum in the tank for cooling; for example, the angle of the side walls from a horizontal plane are preferably about 50° to about 80° (e.g., 50° to)80° depending on viscosity and most preferably about 70° to about 80° (e.g., 70° to)80° for viscous citrus waste high solids mixtures. The apparatus further contains a rotational spreader 8 which may be a disc or propeller mounted on a shaft 13 which is turned by a motor 3 mounted through a vacuum seal 4 on top of the tank rated to maintain a vacuum of at least twenty eight inches mercury (28" Hg) or better;

rotational spreader 8 is at or near the top of the tank. The vacuum seal 4 is around the shaft 13 that connects the rotational spreader 8 and motor 3 where the shaft 13 enters the tank 1, the seal maintains the vacuum differential between the inside and outside of the tank where the shaft enters the tank. Optionally, the motor may be mounted inside the tank thus making the use of the shaft vacuum seal unnecessary. The hot viscous mixture 9 is inputted through input pipe 2 into the tank 1 by a control valve or a pump (not shown in FIG. 1), broken apart into small particles (e.g., having a diameter less than about 77 millimeters (e.g., less than 77 mm), preferably ranging from about 1 to about 6 millimeters (e.g., 1-6 mm)) by the rotating spreader which dramatically increases the surface area (e.g., by about 10 to about 10,000 times greater than a static filled tank exposed to the vacuum) of the viscous material exposed to the vacuum for increased cooling efficiency and then deposited onto the tank sidewalls where the material slides to the bottom of the tank. The resulting cooled mixture 11 is then outputted from the bottom by a control pump or valve 7 and cooled mixture output pipe 12 to a next stage which may be the fermentation stage or another cooling tank as the process is illustrated in FIG. 2. At least one vacuum pump 5 is employed to maintain the desired vacuum in the tank 1 at all times during the cooling process; additional vacuum pumps 6 may be utilized in either a parallel or serial arrangement. Optionally, if the viscosity of the material permits, a spray jet may be used to replace the rotational spreader to reduce the process material in size and distribute the material to the tank sidewalls.

Figure 2:
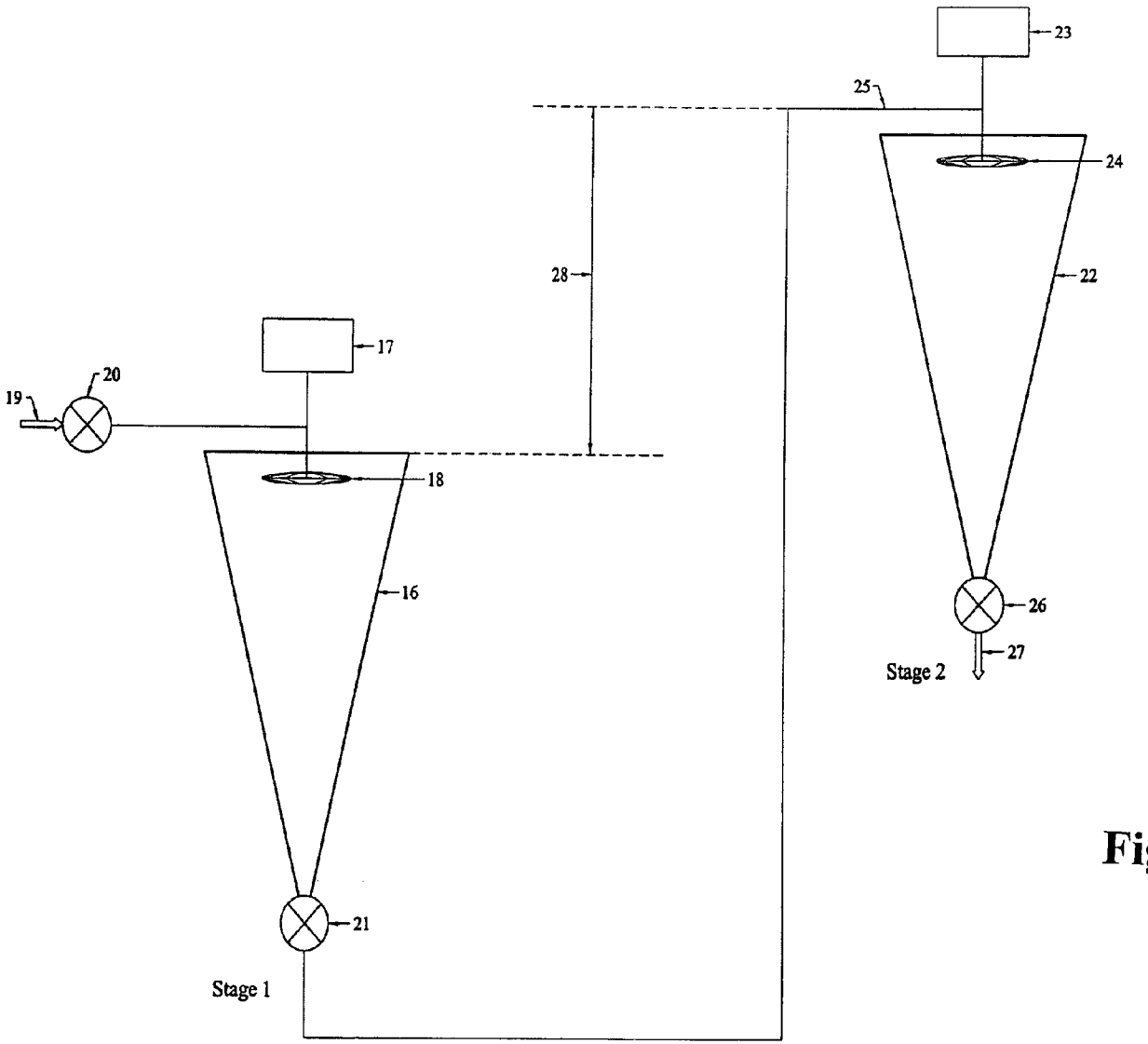
FIG. 2 shows a schematic diagram of a two-stage embodiment employing the apparatus and method of the present invention.

FIG. 2 illustrates a two-stage system employing the apparatus and method of the present invention as discussed in more detail in relation to FIG. 1. A cooked or heated viscous mixture 19 is inputted by a control valve or pump 20 in a first stage vacuum cooling tank 16 and is broken up into small particles and distributed by a rotational spreader 18 rotated by motor 17, it is cooled in tank 16 and then outputted by a pump or valve 21 to a like stage cooling tank 22. Like the first stage cooling tank 16, the second stage cooling tank 22 has a rotational spreader 24 rotated by motor 23 to break up the viscous mixture into small particles and distribute the input viscous mixture 25 for cooling in tank 22, the cooled viscous mixture then being outputted from the tank 22 by a valve or control pump 26 as cooled viscous mixture output 27 to the next stage which can be an additional cooling stage or another process. Optionally, if the viscosity of the material permits, a spray jet may be used to replace the rotational spreader to reduce the process material in size and distribute the material to the tank sidewalls.

Optionally a difference in height 28 between the two stages as illustrated in FIG. 2 may be applied preferably, the difference in height is about six feet (e.g., six feet) which would result in about six inch (e.g., 6") mercury (HG) equivalent differential in peel hydrostatic pressure. For instance, the vacuum pressure in the first stage may be 23" HG and the second stage 29" HG. The differential in pressure contributing to further cooling.

In one pilot plant trial, a temperature drop of 95° to 47° C. at a continuous flow rate of one gallon per minute was achieved in a one stage 60 gallon capacity cooling tank. In a second trial, pumping the 47° C. mixture through the 60 gallon capacity tank a second time to simulate a two-stage system, a further temperature drop of 47° to 39° C. was accomplished at a flow rate of five gallons per minute. In an additional trial of two stage cooling using two 400 gallon capacity vacuum tanks connected to separate vacuum pumps, a temperature drop from 98° C. to 41° C. was achieved at a flow rate of 10 to 15 gallons/minute.

Thus, as described herein, a method and apparatus for cooling viscous and/or high solids containing mixtures is disclosed which will enable such viscous mixtures to be cooled more rapidly, more evenly and in a continuous manner which will expedite the production process for which it is used.

Although only a few embodiments of the present invention have been described in detail hereinabove, all improvements and modifications to this invention within the scope or equivalents of the claims are included as part of this invention.

Unless defined otherwise, all technical and scientific terms used herein have the same meaning as commonly understood by one of ordinary skill in the art to which the invention belongs. Any methods and materials similar or equivalent to those described herein can be used in the practice or testing of the present invention.

All of the references cited herein are incorporated by reference in their entirety. Also incorporated by reference in their entirety are the following references: McDonald, K., and D. Sun, Journal of Food Engineering 45: 55-65 (2000); U.S. Pat. No. 6,076,362.

Thus, in view of the above, the present invention concerns (in part) the following:

An apparatus for vacuum cooling heated viscous and/or high solids mixtures, comprising (or consisting essentially of or consisting of):

a tank having a top, a bottom, and side walls sloping inwardly at a predetermined angle from the top to the bottom of the tank;

means for inputting the heated viscous and/or high solids mixtures into the tank;

means for breaking the inputted viscous and/or high solids mixture into particles and then distributing the inputted viscous and/or high solids mixtures onto the side walls of the tank, said means being located inside and proximate the top of the tank;

means for drawing a vacuum in the tank; and means for outputting the viscous and/or high solids mixtures from the bottom of the tank.

The above apparatus wherein the means for inputting the heated viscous and/or high solids mixtures into the tank comprises a pump.

The above apparatus where the means for inputting the heated viscous and/or high solids mixture into the tank comprises a flow control valve The above apparatus wherein the means for breaking the viscous and/or high solids mixtures into particles and then distributing the inputted viscous and/or high solids mixture onto the side walls of the tank comprises a rotational spreader operatively connected to a motor. The apparatus wherein said rotational spreader is a propeller or a disc.

The above apparatus wherein the means for breaking the viscous and/or high solids mixtures into particles and then distributing the inputted viscous and/or high solids mixture onto the side walls of the tank comprises a spray jet The above apparatus wherein the means for outputting the viscous and/or high solids mixtures from the bottom of the tank comprises a pump or a valve with a gravity seal.

The above apparatus wherein the angle of the side walls of the tank is determined by the angle of repose of the viscous and/or high solids mixtures.

The above apparatus wherein the angle of the side walls from a horizontal plane is about 50° to about 85°. The apparatus wherein the angle of the side walls from a horizontal plane is about 70° to about 80°.

The above apparatus wherein the particles have a diameter of less than about 77 millimeters (e.g., 1 to less than 77 mm). The apparatus wherein the particles have a diameter of about 1 to about 6 millimeters.

The above apparatus further comprising at least one additional tank of like construction, each tank having a greater vacuum pressure than the previous tank for further cooling of the viscous and/or high solids mixtures.

A method for vacuum cooling heated viscous and/or high solids mixtures using an apparatus comprising (or consisting essentially of or consisting of):

a tank having a top and a bottom and side walls sloping inwardly at a predetermined angle from the top to the bottom of the tank;

means for inputting the heated viscous and/or high solids mixtures into the tank;

means for breaking the inputted viscous and/or high solids mixture into particles and then distributing the inputted viscous and/or high solids mixtures onto the side walls of the tank, said means being located inside and proximate the top of the tank;

means for drawing a vacuum in the tank; and means for outputting the viscous and/or high solids mixtures from the bottom of the tank;

said method comprising drawing a vacuum in the tank; inputting the heated viscous and/or high solids mixtures into the tank; breaking the viscous and/or high solids mixture apart into particles and distributing the heated viscous and/or high solids mixtures onto the side walls of the tank;

and outputting the viscous and/or high solids mixtures from the bottom of the tank.

The above method wherein the means for inputting the viscous and/or high solids mixtures into the tank comprises a pump.

The above method of wherein the means for inputting the viscous and/or high solids mixtures into the tank comprises a flow control valve.

The above method wherein the means for breaking the viscous and/or high solids mixtures into particles and then distributing the inputted viscous and/or high solids mixture onto the side walls of the tank comprises a rotational spreader operatively connected to a motor. The method wherein the rotational spreader is a propeller or a disc.

The above method wherein the means for breaking the viscous and/or high solids mixtures into particles and then distributing the inputted viscous and/or high solids mixture onto the side walls of the tank comprises a spray jet.

The above method wherein the means for outputting the viscous and/or high solids mixture from the bottom of the tank comprises a pump or a valve with a gravity seal.

The above method wherein the angle of the side walls of the tank is determined by the angle of repose of the viscous and/or high solids mixtures.

The above method wherein the angle of the side walls from a horizontal plane is about 50° to about 85°. The method wherein the angle of the side walls from a horizontal plane is about 70° to about 80°.

The above method wherein the particles have a diameter of less than about 77 millimeters (e.g., 1-less than 77 mm). The method wherein the particles have a diameter of about 1 to about 6 millimeters.

The above method comprising further steps of inputting the viscous and/or high solids mixtures into at least one additional tank of similar construction to the previous tank and having a vacuum pressure higher than the previous tank to accomplish further cooling; and outputting the viscous and/or high solids mixture from at least one additional tank to the next stage of a process.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

We claim:

1. An apparatus for vacuum cooling heated viscous and/or high solids mixtures, comprising:

a tank having a top, a bottom, and side walls sloping inwardly from the top of the tank;

means for inputting the heated viscous and/or high solids mixtures into the tank; and means for breaking the viscous and/or high solids mixture into particles and then distributing the viscous and/or high solids mixtures onto the side walls of the tank, said means being located in a vacuum space inside and proximate the top of the tank, the viscous and/or high solids mixture flowing to the means for breaking the viscous and/or high solids mixtures into particles.

2. The apparatus of claim 1 wherein the means for inputting the heated viscous and/or high solids mixtures into the tank comprises a pump.

3. The apparatus of claim 1 where the means for inputting the heated viscous and/or high solids mixture into the tank comprises a flow control valve.

4. The apparatus of claim 1 wherein the means for breaking the viscous and/or high solids mixtures into particles and then distributing the inputted viscous and/or high solids mixture onto the side walls of the tank comprises a rotational spreader operatively connected to a motor.

5. The apparatus of claim 4 wherein said rotational spreader is a propeller or a disc.

6. The apparatus of claim 1 wherein the means for breaking the viscous and/or high solids mixtures into particles and then distributing the viscous and/or high solids mixture onto the side walls of the tank comprises a spray jet.

7. The apparatus of claim 1 further comprising a means for outputting the viscous and/or high solids mixtures from the bottom of the tank, wherein the means for outputting the viscous and/or high solids mixtures from the bottom of the tank comprises a pump or a valve with a gravity seal.

8. The apparatus of claim 1 further comprising at least one additional tank of like construction, each tank having a greater vacuum pressure than the previous tank for further cooling of the viscous and/or high solids mixtures.

9. The apparatus of claim 1 wherein an angle of the side walls of the tank is determined by the angle of repose of the viscous and/or high solids mixtures.

10. The apparatus of claim 1 wherein an angle of the side walls from a horizontal plane is about 50° to about 85°.

11. The apparatus of claim 1 wherein an angle of the side walls from a horizontal plane is about 70° to about 80°.

12. The apparatus of claim 1 wherein the means for breaking the viscous and/or high solids mixture into particles is structured so that the particles have a diameter of less than about 77 millimeters.

13. The apparatus of claim 1 wherein the means for breaking the viscous and/or high solids mixture into particles is structured so that particles have a diameter of about 1 to about 6 millimeters.

14. A method for vacuum cooling heated viscous and/or high solids mixtures, the method comprising the steps of:

providing a tank with inwardly sloping walls;

attaching a means for inputting a viscous and/or high solids fluid proximate a top of the tank;

positioning a means for breaking the viscous and/or high solids fluid into particles in a vacuum space proximate the top of the tank;

inputting the heated viscous and/or high solids mixtures into the tank to the means for breaking the viscous and/or high solids fluid into particles;

breaking the viscous and/or high solids mixture apart into particles;

distributing the heated viscous and/or high solids mixtures onto the side walls of the tank; and, outputting the viscous and/or high solids mixtures from the bottom of the tank.

15. The method of claim 14 comprising further steps of:

inputting the viscous and/or high solids mixtures into at least one additional tank of similar construction to the previous tank, and applying a vacuum pressure higher than the previous tank to accomplish further cooling; and outputting the viscous and/or high solids mixture from at least one additional tank to the next stage.

16. The method of claim 14 wherein, in the imputing step, the means for inputting the viscous and/or high solids mixtures into the tank comprises a pump.

17. The method of claim 14 wherein, in the inputting step, the means for inputting the viscous and/or high solids mixtures into the tank comprises a flow control valve.

18. The method of claim 14 wherein, in the breaking step, the means for breaking the viscous and/or high solids mixtures into particles and then distributing the viscous and/or high solids mixture onto the side walls of the tank comprises a rotational spreader operatively connected to a motor.

19. The method of claim 18 wherein the rotational spreader is a propeller or a disc.

20. The method of claim 14 wherein, in the breaking step, the means for breaking the viscous and/or high solids mixtures into particles and then distributing the viscous and/or high solids mixture onto the side walls of the tank comprises a spray jet.

21. The method of claim 14 wherein, in the outputting step, the means for outputting the viscous and/or high solids mixture from the bottom of the tank comprises a pump or a valve with a gravity seal.

* * * * *